US011267607B2

(12) United States Patent
Lieber

(10) Patent No.: US 11,267,607 B2
(45) Date of Patent: Mar. 8, 2022

(54) APPARATUS, SYSTEM AND METHODS FOR A FOLD DOWN MULTIPLE CAVITY DIVIDER

(71) Applicant: Michael Lieber, Highland Park, IL (US)

(72) Inventor: Michael Lieber, Highland Park, IL (US)

( * ) Notice: Subject to any disclaimer, the term of this patent is extended or adjusted under 35 U.S.C. 154(b) by 0 days.

(21) Appl. No.: 16/792,542

(22) Filed: Feb. 17, 2020

(65) Prior Publication Data

US 2020/0180809 A1 Jun. 11, 2020

Related U.S. Application Data

(63) Continuation of application No. 15/670,616, filed on Aug. 7, 2017, now Pat. No. 10,589,891, which is a continuation of application No. 14/738,496, filed on Jun. 12, 2015, now abandoned.

(60) Provisional application No. 62/011,357, filed on Jun. 12, 2014.

(51) Int. Cl.
*B65D 5/42* (2006.01)
*B65D 5/36* (2006.01)

(52) U.S. Cl.
CPC ..... *B65D 5/4275* (2013.01); *B65D 5/36* (2013.01); *B65D 2313/02* (2013.01)

(58) Field of Classification Search
CPC ..... B65D 21/086; B65D 25/04; B65D 5/36; B65D 5/42; B65D 5/4275; B65D 5/4279; B65D 5/4283; B65D 5/4287; B65D 2313/02
See application file for complete search history.

(56) References Cited

U.S. PATENT DOCUMENTS

| | | | |
|---|---|---|---|
| 1,447,636 | A | 3/1923 | White |
| 2,676,731 | A | 4/1954 | Klein |
| 3,369,659 | A | 2/1968 | Ettlinger, Jr. |
| 3,519,318 | A | 7/1970 | Hagen |
| 3,791,549 | A | 2/1974 | Delbrouck et al. |
| 4,739,809 | A | 4/1988 | Adams |

(Continued)

FOREIGN PATENT DOCUMENTS

| | | | |
|---|---|---|---|
| DE | 3723058 | A1 | 5/1988 |
| DE | 4208775 | A1 | 9/1993 |

(Continued)

*Primary Examiner* — Don M Anderson
(74) *Attorney, Agent, or Firm* — Patzik, Frank & Samotny Ltd.

(57) ABSTRACT

An improved collapsible container configured with a base member and at least one multiple cavity or compartment divider either permanently or removably attached to the base member at a pivot point. The multiple cavity divider is configured to close into a relatively flat portion that can be rotated about the pivot point and positioned against the base portion in a storage state, and the multiple cavity divider is configured to be expanded into an open position about the pivot point to create a number of separate cavities. Further, the base member is configured to provide support for the bottom of each of the cavities when the multiple cavity divider is in the expanded position, and the base member is configured to provide support for the multiple cavity divider when it is in the fold down or storage position.

8 Claims, 2 Drawing Sheets

(56) References Cited

U.S. PATENT DOCUMENTS

| | | | | |
|---|---|---|---|---|
| 5,518,170 | A * | 5/1996 | Rasmussen | B65D 5/36 224/42.34 |
| 5,533,534 | A | 7/1996 | Cariello | |
| 6,352,321 | B1 | 3/2002 | Munoz | |
| 7,264,127 | B2 | 9/2007 | Jones | |
| 7,954,639 | B2 * | 6/2011 | Carney | A47B 43/003 206/579 |
| 8,998,011 | B2 | 4/2015 | Zhu | |
| 2003/0010780 | A1 * | 1/2003 | Redzisz | A45C 7/0095 220/6 |
| 2005/0087530 | A1 * | 4/2005 | Svenson | B60R 13/011 220/6 |
| 2006/0157368 | A1 | 7/2006 | Kraft | |
| 2007/0080120 | A1 | 4/2007 | Greiner | |
| 2007/0241154 | A1 | 10/2007 | Potts | |
| 2012/0217248 | A1 * | 8/2012 | Ma | B32B 37/0084 220/500 |
| 2013/0048533 | A1 | 2/2013 | McDonald et al. | |

FOREIGN PATENT DOCUMENTS

| | | | |
|---|---|---|---|
| EP | 2481684 | B1 | 8/2012 |
| WO | 2013043073 | | 2/2013 |

* cited by examiner

APPARATUS, SYSTEM AND METHODS FOR A FOLD DOWN MULTIPLE CAVITY DIVIDER

PRIORITY STATEMENT

This application is a continuation of Nonprovisional application Ser. No. 15/670,616 filed Aug. 7, 2017, allowed on Feb. 4, 2020, which is a continuation of Nonprovisional application Ser. No. 14/738,496 filed Jun. 12, 2015, now abandoned, which claims the benefit of U.S. Provisional Application 62/011,357 filed Jun. 12, 2014; all of which are hereby incorporated by reference in their entirety.

BACKGROUND a. Technical Field

The instant disclosure relates to an apparatus, system and methods for a collapsible storage container, and in particular, the instant disclosure relates to a one-piece fold down or knock down multiple cavity divider or multiple compartment divider, attached to a base member for use in safely securing, storing and/or transporting all types of items, including, but not limited to, sturdy or non-breakable items such as shoes and clothes, and also fragile or breakable items, such as ornaments, stemware, fine china, crystal glasses, glass sculptures, and the like. Any item of a size and shape that can fit within the cavity or compartment can be safely secured in the container described in the present disclosure. The one-piece fold down multiple cavity or container divider can be collapsed onto the base member for storage purposes, and one or more of the one-piece fold down multiple cavity dividers can be either permanently or removably attached to the base member to create a larger multiple cavity unit.

b. Background Art

Individuals collect, store, transport and/or use breakable and non-breakable items, such as shoes and clothes, ornaments, stemware, fine china cups, crystal glasses, glass sculptures, etc. However, when it comes to safely and securely storing and/or transporting these items, the current storage containers are large and bulky, and take up a lot of room when not in use.

In order to provide a protective package for these items during storage or transport, a container comprising separate spaces can be used along with a cushioning member inside each separate space. The cushioning member provides the necessary protection for the items and may consist of paper or plastic packing material, STYROFOAM®, formed foam or air-filled cushions, among other protective articles. These cushioned members can be placed in the separate spaces and then surround the fragile item to protect it from shock and impact during storage or transportation.

However, when the item is removed from the container for use, the container with the cushioning member cannot be reduced in size for easy storage. In other words, the container must remain in its original size and shape. What is needed is a container that can safely store multiple items and can be reduced in size when not in use, and then expanded again in order to provide the needed protection when the items are returned to the container for storage or transport. The container should be able to be reduced in size to be flat when not in use.

BRIEF SUMMARY

In accordance with the present disclosure, an improved apparatus, system and method is disclosed for safely securing, storing and/or transporting all types of items, including, but not limited to, sturdy or non-breakable items such as shoes and clothes, and also fragile or breakable items, such as ornaments, stemware, fine china, crystal glasses, glass sculptures, and the like. As used herein, these items are referred to as items or storage items, but as understood by one having ordinary skill in the art, the terms items and storage items broadly cover any item of a size and shape that can fit within the cavity or compartment of the container.

The container apparatus and system is configured to be expanded from a relatively flat position, into a multiple cavity or compartment divider for safely and securely supporting, storing and transporting multiple storage items.

In accordance with the present disclosure, a collapsible container is configured with a base member and one or more one-piece multiple cavity dividers either permanently or removably attached to the base member at a pivot point. The one-piece multiple cavity divider is configured to fold down, knock down or be closed into a relatively flat, storage position that can be rotated about the pivot point and placed against the base portion in a storage state, and the one-piece multiple cavity divider is configured to be expanded into an open position about the pivot point to create a number of separate cavities or compartments.

Further, the base member is configured to provide support for the bottom of each of the cavities when the one-piece multiple cavity divider is in the expanded position, and is configured to provide support for the one-piece multiple cavity divider when it is in the fold down, knock down, closed or storage position. Additional one-piece multiple cavity dividers can be attached permanently or removably attached to the base member to create a larger multiple cavity device, with each of the one-piece multiple cavity dividers also configured to be expanded for use or closed for storage of the device when not in use.

Each of the one-piece multiple cavity dividers can be pivotally attached to the base member permanently by gluing, stapling or sewing, or any other permanent attachment method, in such a configuration that allows each one-piece multiple cavity divider to be closed into its storage state and then folded down around the pivot point onto the base member. With this configuration, when the one-piece multiple cavity divider is folded down, the entire container apparatus will lay flat or substantially flat and can be stored easier than a box that would hold the same number of storage items and not have the ability to be collapsed down.

Additionally, each of the one-piece multiple cavity dividers can be pivotally and removably attached to the base member at the pivot point, with the use of a hook and loop closure, such as VELCRO®, or with buttons, zippers, or any other non-permanent attachment method, as known by those having ordinary skill in the art.

Further, the one-piece multiple cavity divider, once permanently or removably attached to the base, can be placed into a separate case that may or may not have a top that can close over the collapsible container. Additionally, the one-piece multiple cavity divider may use hook and loop closures, or other removable attachment methods to provide support between the base and each one-piece multiple cavity divider when in the expanded position. Along those lines, and as an example, each base member may have a hook flap that can attach to a loop flap on the divider when expanded to provide additional support between the base member and the one-piece multiple cavity divider.

An embodiment of a method of operating a fold down one-piece multiple cavity divider, including the container described above, may include a number of steps. The method may include expanding the one-piece multiple cavity divider by rotating the divider about the pivot point and expanding the divider to open up and expose the multiple cavities with a portion of the base member forming the base or bottom of each cavity. At this time, any storage items can be placed into each cavity or compartment for securely supporting the items during storage and/or transport.

When the container is no longer to be used for storage or transport and all of the storage items have been removed, the one or more one-piece multiple cavity dividers can be folded down and rotated about the pivot point to create a relatively flat divider unit supported by the base member at the permanent or removably attached location. If the one-piece multiple cavity divider is removably attached to the base member, the one-piece multiple cavity divider can be removed from the base member for ease of storage of the container.

Other objects and advantages of the present disclosure will become apparent to one having ordinary skill in the art after reading the specification in light of the drawing figures, however, the spirit and scope of the present invention should not be limited to the description of the embodiments contained herein.

DETAILED DESCRIPTION

As stated herein, the objective of the present disclosure is to provide an apparatus, system and related methods for a collapsible storage container comprising one or more one-piece fold down multiple cavity dividers attached to a base member for use in safely securing fragile or other items, and for storing and/or transporting those items. For example, the items may include ornaments, stemware, fine china cups, crystal glasses, glass or other fragile sculptures, and the like. Each of the cavities in the one-piece multiple cavity divider can be the same size as the other cavities or can be different sizes as the other cavities as further described below.

The container is not limited to storing storage items and can be used for storage and/or transport of any items that would fit into the cavities when they are in the open or expanded position as described herein. The one-piece fold down multiple cavity divider will be permanently or removably attached to the base member and can be collapsed onto the base member for storage purposes. Additional fold down multiple cavity dividers can be attached to the base member to create a larger multiple cavity unit, thereby supporting or holding more items in the increased number of cavities.

The foregoing discussion is intended only to illustrate the present field and should not be taken as a disavowal of claim scope. As described herein, terms of orientation, such as upper, lower, top, bottom, left, right, front, back, side, longitudinal, horizontal, vertical, lateral, mid-point and end are used here to simplify the description in the context of the illustrated embodiments. Because other orientations are possible, however, the collapsible storage container described herein should not be limited to the illustrated orientations. Those skilled in the art will appreciate that other orientations of the apparatus described herein are possible.

Figure 1:
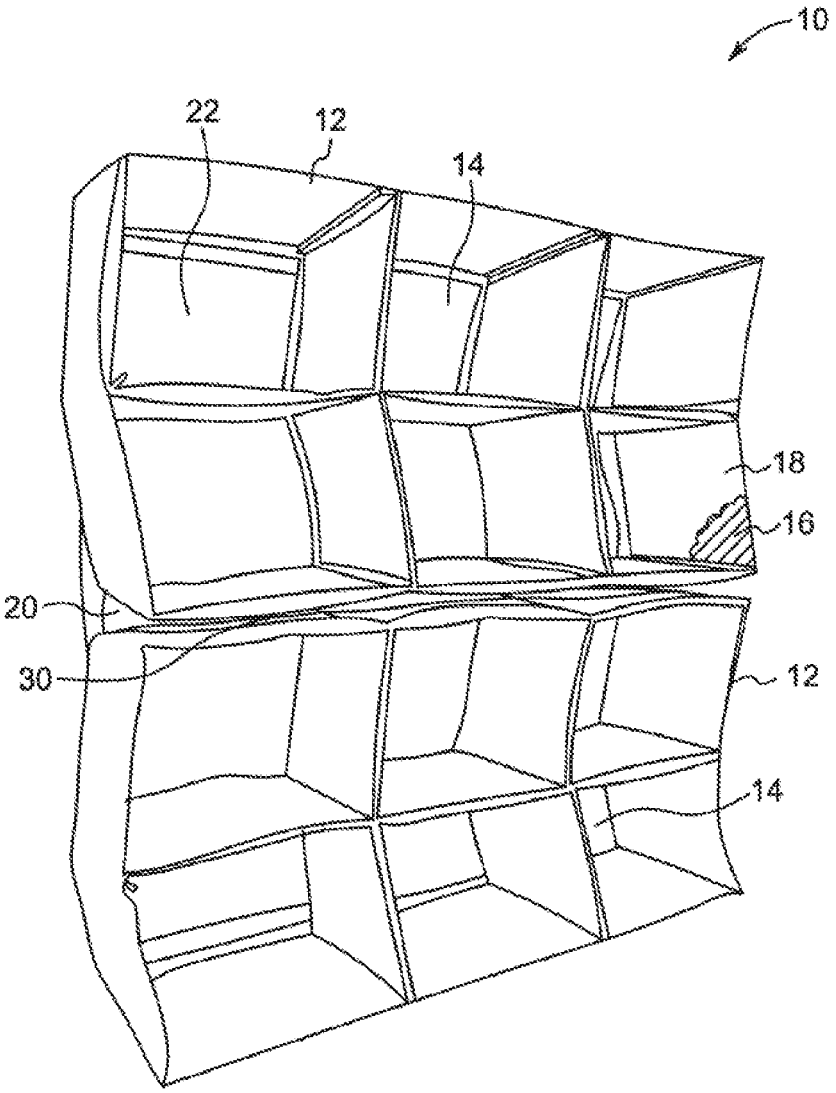
FIG. 1 is a perspective view of the collapsible container apparatus and system in accordance with the present invention in the expanded position.
Figure 2:
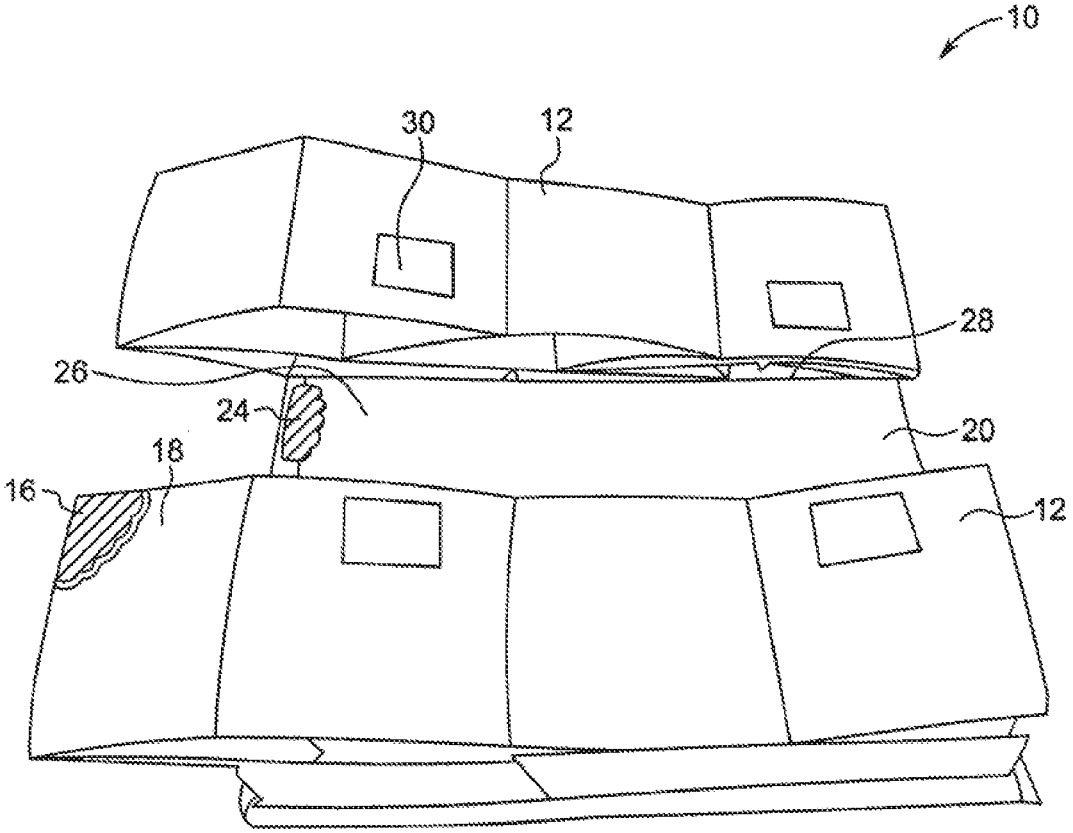
FIG. 2 is a perspective view of the collapsible container apparatus and system in accordance with the present invention in the collapsed position.

Referring to the drawings, wherein like reference numerals refer to the same or similar features in the various views, FIG. 1 shows a collapsible storage container 10, which comprises one or more one-piece fold down multiple cavity dividers 12, which are made up of individual and separate cavities 14 attached to one another in such a configuration that the entire one-piece multiple cavity divider 12 can be folded down into a flat or substantially flat position (shown in FIG. 2). It should be understood that in the flat or substantially flat position, storage items will not fit into the cavities. The one-piece divider 12 can be made up of chipboard 16 with a covering 18 as described below, such that each cavity 14 is attached to the other cavities 14 both during storage use when expanded, and when not in use and in the closed position.

In the preferred embodiment, each cavity 14 is the same size as the other cavities 14, approximately 3⅝ inches high by 3¼ inches wide and 4 inches deep, and there are six cavities 14 for each divider 12. However, in alternative embodiments, the cavities 14 are different sizes from one another and there can be more or less than six cavities 14. As an example, a divider 12 may consist of five cavities 14 in which one cavity 14 is the same width as the other four cavities, but twice the height. Other divider 12 configurations are possible as long as the divider 12 can be expanded into an open position for securing storage items and then collapsed into a closed position when not in use.

The one-piece multiple cavity divider 12 of the preferred embodiment will include six cavities 14 and be approximately 10¾ inches high by 6½ inches wide and 4 inches deep. If two dividers 12 are used next to each other, the entire collapsible container 10 will use 12 cavities 14 and will be approximately 10¾ inches high by 13 inches wide and 4 inches deep (with approximately an additional ⅛ inch between the two dividers 12. It should be understood that the one-piece multiple cavity divider might include a configuration with multiple pieces to the extent that those multiple pieces can be combined to provide similar functionality as the one-piece design.

In order to accept and support storage items when necessary, the walls of the dividers 12, which in the preferred embodiment are 4 inches deep, are made of fabric 18 covered over chipboard 16. In some cases, foam or cloth padding (not shown) can be inserted between the chipboard 16 and fabric 18 for further protection of the storage items. Other materials can be used for the dividers 12 and still retain the supportive properties of the divider cavities 14 without damaging the storage items placed into the cavities 14.

Also shown in FIG. 1 is the base member 20, which creates the back or bottom 22 of each cavity 14. As such, when the one-piece multiple cavity divider 12 is in the open or expanded position (as shown), and properly placed over the base member 20, the bottom 22 of each cavity 14 will be a portion of the base member 20, and will safely secure the storage items in the cavity 14.

In the preferred embodiment, the portion of the base member 20 that will form the bottom 22 of the cavity 14 will be approximately 3⅝ inches high by 3¼ inches wide. Similar to the divider 12, the base member 20 can be made up of chipboard 24 with a covering 26. However, as understood by one having ordinary skill in the art, numerous materials, such as cloth, plastic, cardboard, etc., can be used for the base member 20, as long as the material and any padding does not damage the storage items placed in the cavity 14 and allows for a portion of the base member to form a bottom 22 of the cavity or compartment 14. As such the base member can be rigid, semi-rigid, or flexible.

As shown in FIGS. 1 (expanded) and 2 (collapsed), in which two one-piece multiple cavity dividers 12 are incorporated into the collapsible container 10, the base member 20 will be approximately 10¾ inches high by 13 inches wide and 4 inches deep (with approximately an additional ⅛ inch between the two dividers 12. When the container 10 is collapsed, the multiple cavity dividers 12 extend beyond the perimeter of the base portion 20. However, each one-piece multiple cavity divider 12 can be configured to fold over further, so that the closed multiple cavity divider 12 does not extend beyond the perimeter of the base portion 20.

In order to create the fold down aspect of the present disclosure, each of the multiple cavity dividers 12 are pivotally attached to the base member 20 in a manner that allows each cavity 14 in the one-piece multiple cavity dividers 12 to close up and the one or more one-piece multiple cavity dividers 12 can then lie flat against the base member 20. The pivot point 28 can create a connection as described below, at all points along the pivot line 28, or there may only be a few places where the multiple cavity divider 12 is pivotally attached to the base member 20.

As described herein, the one-piece multiple cavity dividers 12 can be permanently or removably attached to the base member 20. Either way, the attachment will create a pivot or pivot point 28 between the multiple cavity dividers 12 and the base member 20. The pivot 28 can be permanent through stitching or sewing, or by applying glue, or by stapling or any other permanent attachment method. In this configuration, the one-piece multiple cavity divider 12 can be closed and then folded down around the pivot point 28 flat against the base member 20. With this configuration, when the one-piece multiple cavity divider 12 is folded down, the entire collapsible container 10 will lay flat as shown in FIG. 2, and the container 10 can be easily stored.

Additionally, each of the one-piece multiple cavity dividers 12 can be pivotally and removably attached to the base member 20 with the use of a hook and loop closure, such as VELCRO®, or with buttons, zippers, or any other attachment method that would allow the one-piece multiple cavity divider 12 to be removed from the base member 20 without damaging the container 10, as known by those having ordinary skill in the art.

Additional one-piece multiple cavity dividers 12 can be attached permanently or removably attached to the base member 20 to create a larger collapsible container 10 having more than a single one-piece multiple cavity divider 12, with each of the one-piece multiple cavity dividers 12 also configured to be expanded for use, or closed for lying flat when not in use.

Further, the one-piece multiple cavity divider 12, once it is permanently or removably attached to the base member 20, can be placed into a separate case (not shown) that may or may not have a top, that can close over the collapsible container 10. Additionally, the one-piece multiple cavity divider 12 may use hook and loop closures, or other removable attachment methods to provide support between the base member 20 and each one-piece multiple cavity divider 12 when in the expanded position. Along those lines, and as an example, each base member 20 may have multiple hook flaps that can attach to corresponding loop flaps on the one-piece multiple cavity divider 12 when expanded, to provide additional support between the base member 20 and the one-piece multiple cavity divider 12.

Additionally, a multiple cavity divider attachment 30 such as a hook and loop closure, VELCRO®, buttons, zippers, clips or any other attachment method can be used on the sides of the one-piece multiple cavity dividers 12, when more than a single one-piece divider 12 is used. This allows for the each one-piece multiple cavity divider 12 to be attached to each other one-piece multiple cavity divider 12 when in use. If for example, VELCRO® is used and placed on the side of each one-piece multiple cavity divider 12 as shown in FIG. 2, when the one-piece dividers 12 are expanded and moved into position to secure the storage items, the VELCRO® multiple cavity divider attachment 30 will hold the one-piece dividers 12 together as shown in FIG. 1.

In an embodiment, the entire collapsible container 10, comprising the base member 20 and one or more of the one-piece multiple cavity dividers 12, can be placed into a separate enclosure (not shown) having a bottom, sides and possibly a top to cover each of the sides and the bottom of the container 10. If more than a single one-piece divider 12 is used, the multiple cavity or compartment dividers 12 can be attached to each other using the multiple cavity divider attachment 30, as described herein. If the enclosure has a top, it can be closed with the use of zippers, buttons, a hook and loop closure, such as VELCRO® or any other manner to further protect the storage items or the contents of the container 10 during storage or transport.

In another similar embodiment, one or more one-piece multiple cavity or compartment dividers 12 can be attached to each other using the multiple cavity divider attachment 30 (if more than one dividers 12 are used) and then placed into a separate enclosure (as described above) having a bottom and sides, and possibly a top to cover the container 10, without using the base member 20 described herein. In this embodiment, the bottom of the case acts as a base member 20 and the one-piece multiple cavity divider 12 can be permanently or removably attached to the bottom of the case.

Although the present disclosure is for a one-piece multiple cavity divider 12, it should be understood that the one-piece multiple cavity divider might include a configuration with multiple pieces, to the extent that those multiple pieces can be combined to provide similar functionality as the one-piece design. For example, a multiple piece divider can be incorporated into the container 10, to the extent it can provide the same functionality and ease of use as the one-piece multiple cavity divider 12.

An embodiment of a method of operating a collapsible container 10, comprising one or more one-piece fold down multiple cavity dividers 12, and a base member 20, may include a number of steps. The method may include as a first step (with a collapsed container 10), expanding the one-piece multiple cavity divider 12 by rotating the divider 12 about the pivot point 28 and expanding the one-piece divider 12 to open up and expose the multiple cavities 14 with a portion of the base member 20 forming the base or bottom 22 of each cavity 14. At this time, any storage items or any items of the proper size can be placed into each cavity 14 for securely supporting the items during storage and/or transport.

When the container 10 no longer needs to be used for storage or transport, and all of the storage items have been removed from all of the cavities 14, the one-piece multiple cavity dividers 12 can be folded down and rotated about the pivot point 28 to create a relatively flat divider unit 12 supported by the base member 20 at the permanent or removably attached location 28. If the one-piece multiple cavity divider 12 is removably attached to the base member 20, the one-piece multiple cavity divider 12 can be removed from the base member 20 for storing the container.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details.

In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments" "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment. Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional.

Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure. As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A collapsible storage container configured to expand to securely accept and contain storage items, and configured to close to a substantially flat position, comprising:

a. a first one-piece multiple compartment divider, said first one-piece multiple compartment divider comprising at least two first compartments, said at least two first compartments capable of accepting and securely containing storage items, said first one-piece multiple compartment divider being configured to expand into said at least two first compartments, said first one-piece multiple compartment divider having a first attachment, said first one-piece multiple compartment divider being configured to collapse into a substantially flat position; and b. a second one-piece multiple compartment divider, said second one-piece multiple compartment divider comprising at least two second compartments, said at least two second compartments capable of accepting and securely containing storage items, said second one-piece multiple compartment divider being configured to expand into said at least two second compartments, said second one-piece multiple compartment divider having a second attachment, such that said first attachment and said second attachment allow for the first attachment to be attached to said second attachment, said second one-piece multiple compartment divider being configured to collapse into a substantially flat position; and c. a base member, said base member being substantially flat, wherein said first one-piece multiple compartment divider is attached to said base member at a first pivot point, and wherein said second one-piece multiple compartment divider is attached to said base member at a second pivot point, such that when said first one-piece multiple compartment divider is converted into its substantially flat position, and said second one-piece multiple compartment divider is converted into its substantially flat position, said first one-piece multiple compartment divider will then rotate about the first pivot point and lie substantially flat against the base member, and said second one-piece multiple compartment divider will then rotate about the second pivot point and lie substantially flat against the base member.

2. The collapsible storage container configured to expand to securely accept and contain storage items, and configured to close to a substantially flat position in claim 1, wherein said at least two first compartments comprises six separate compartments.

3. The collapsible storage container configured to expand to securely accept and contain storage items, and configured to close to a substantially flat position in claim 2, wherein said six separate compartments are all of the same size.

4. The collapsible storage container configured to expand to securely accept and contain storage items, and configured to close to a substantially flat position in claim 2, wherein said six separate compartments are at least two different sizes.

5. The collapsible storage container configured to expand to securely accept and contain storage items, and configured to close to a substantially flat position in claim 1, wherein said first one-piece multiple compartment divider is permanently attached to said base member.

6. The collapsible storage container configured to expand to securely accept and contain storage items, and configured to close to a substantially flat position in claim 5, wherein said first one-piece multiple compartment divider is configured to be permanently attached to said base member by stitching said at least one multiple compartment divider to said base member at said first pivot point.

7. The collapsible storage container configured to expand to securely accept and contain storage items, and configured to close to a substantially flat position in claim 1, wherein said first one-piece multiple compartment divider is removably attached to said base member.

8. The collapsible storage container configured to expand to securely accept and contain storage items, and configured to close to a substantially flat position in claim 7, wherein said first one-piece multiple compartment divider is configured to be removably attached to said base member using a hook and loop closure at said first pivot point.

* * * * *